US010892579B2

(12) United States Patent
Demaratos

(10) Patent No.: US 10,892,579 B2
(45) Date of Patent: Jan. 12, 2021

(54) FEMALE TERMINAL POSITION ASSURANCE (TPA) DEVICE FOR A CONNECTOR AND METHOD FOR ASSEMBLING THEREOF

(71) Applicant: J.S.T. CORPORATION, Farmington Hills, MI (US)

(72) Inventor: David Demaratos, Wixom, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/389,926

(22) Filed: Apr. 20, 2019

(65) Prior Publication Data

US 2020/0274280 A1 Aug. 27, 2020

Related U.S. Application Data

(60) Provisional application No. 62/810,179, filed on Feb. 25, 2019.

(51) Int. Cl.

| | |
|---|---|
| ***H01R 13/436*** | (2006.01) |
| ***H01R 43/20*** | (2006.01) |
| ***H01R 13/424*** | (2006.01) |
| ***H01R 13/502*** | (2006.01) |
| ***H01R 13/629*** | (2006.01) |
| ***H01R 13/639*** | (2006.01) |

(52) U.S. Cl.

CPC ..... *H01R 13/436* (2013.01); *H01R 13/424* (2013.01); *H01R 13/4362* (2013.01); (Continued)

(58) Field of Classification Search

CPC ..... H01R 13/4223; H01R 13/424; H01R 13/502; H01R 13/629; H01R 13/639; (Continued)

(56) References Cited

U.S. PATENT DOCUMENTS 4,984,998 A * 1/1991 Duncan ..... H01R 13/627 439/352
5,738,543 A * 4/1998 Rollins ..... H01R 13/4362 439/595

(Continued)

FOREIGN PATENT DOCUMENTS

DE 102014108283 A1 12/2015
WO 2018/215026 A1 11/2018

OTHER PUBLICATIONS

International Search Report of the International Searching Authority for International Application No. PCT/US2019/029535 dated Jul. 3, 2019 (2 sheets).

*Primary Examiner* — Gary F Paumen
(74) *Attorney, Agent, or Firm* — Kratz, Quintos & Hanson, LLP

(57) ABSTRACT

A female terminal position assurance (TPA) device provides essential secondary locks resulting in much higher retention forces in assuring that the terminals remain locked inside a female housing. The female TPA device also provides the needed detection if the terminals are not fully inserted or installed inside the female housing so that if such a detection is made, the secondary locks provided by the female TPA device do not occur. That is, once it is detected that the terminals have been fully inserted into the female housing and that the primary locks for the terminals inside the female housing have occurred, the female TPA device is able to be inserted into the female housing and thereby provide the secondary locks for the terminals for a much higher assurance that the terminals remain locked inside the female housing. The female TPA device further includes multiple locks with the female housing, while the female TPA device is in a pre-lock position or a full-lock position inside the female housing.

20 Claims, 11 Drawing Sheets

(52) U.S. Cl.
CPC ..... *H01R 13/502* (2013.01); *H01R 13/629* (2013.01); *H01R 13/639* (2013.01); *H01R 43/20* (2013.01)

(58) Field of Classification Search
CPC ..... H01R 43/20; H01R 13/4365; H01R 13/4362; H01R 13/4368
USPC ..... 439/595, 752
See application file for complete search history.

(56) References Cited

U.S. PATENT DOCUMENTS

| | | | | | |
|---|---|---|---|---|---|
| 5,890,935 | A * | 4/1999 | Pill | H01R 13/4368 | 439/752 |
| 5,967,859 | A * | 10/1999 | Cecil, Jr. | H01R 13/4368 | 439/752 |
| 6,004,158 | A * | 12/1999 | Ward | H01R 13/4361 | 439/595 |
| 6,024,591 | A * | 2/2000 | Foster | H01R 13/5208 | 439/272 |
| 10,153,586 | B1 * | 12/2018 | Schroll | H01R 13/6272 | |
| 2009/0311896 | A1 * | 12/2009 | Myer | H01R 13/4365 | 439/248 |
| 2010/0105254 | A1 * | 4/2010 | Park | H01R 13/40 | 439/752 |
| 2011/0207357 | A1 * | 8/2011 | Dick | H01R 13/4365 | 439/345 |
| 2016/0013575 | A1 | 1/2016 | Campbell | | |
| 2018/0316131 | A1 | 11/2018 | Holub | | |
| 2019/0173220 | A1 * | 6/2019 | Bhat | H01R 13/4365 | |

* cited by examiner

FEMALE TERMINAL POSITION ASSURANCE (TPA) DEVICE FOR A CONNECTOR AND METHOD FOR ASSEMBLING THEREOF

CROSS-REFERENCE TO RELATED APPLICATION

This patent application claims priority to U.S. Provisional Patent Application No. 62/810,179 filed Feb. 25, 2019, which is hereby incorporated herein by reference in its entirety.

BACKGROUND OF THE INVENTION

In a female connector assembly, it is desired that the terminals therein, in addition to being provided with primary locks, be further provided with secondary locks inside a female housing. The secondary locks for the terminals provide for much higher retention forces (in comparison with only the primary locks), and provide a higher assurance that the terminals remain locked inside the female housing. It is further desired that a detection be made if the terminals are not fully inserted or installed inside the female housing so that if such a detection is made, the secondary locks of the terminals do not function.

The female terminal position assurance (TPA) device of this invention provides the essential secondary locks for providing the much higher retention forces and the higher assurance that the terminals remain locked inside the female housing. The female TPA device of this invention also provides the needed detection if the terminals are not fully inserted or installed inside the female housing so that if such a detection is made, the secondary locks provided by the female TPA device do not occur. That is, once it is detected that the terminals have been fully inserted into the female housing and that the primary locks for the terminals inside the female housing have occurred, the female TPA device of this invention is able to be inserted into the female housing and thereby provide the secondary locks for the terminals for a much higher assurance that the terminals remain locked inside the female housing. The female TPA device of this invention is further provided with multiple locks with the female housing, while the female TPA device is in a pre-lock position or a full-lock position.

SUMMARY OF THE INVENTION

This invention is directed to a female TPA device for a female connector assembly, preferably for a high voltage female connector assembly. The female TPA device of this invention does not lock inside the female connector assembly if it detects that the corresponding terminal has not been fully inserted or installed into the female connector assembly; and simultaneously, if the corresponding terminal is not in the fully locked position within the female connector assembly, the terminal blocks or prevents the female TPA device from being locked in the female connector assembly. The female TPA device of this invention is further provided with multiple locks with the female housing, while the female TPA device is in a pre-lock position or a full-lock position.

Moreover, if the female TPA is not in the full-lock position in the female connector assembly, the female connector assembly is, in turn, unable to mate with a male connector assembly. When in the full-lock position, the female TPA device provides the high assurance for the retention forces necessary to lock and retain the terminal within the female connector assembly.

BRIEF DESCRIPTION OF THE DRAWINGS

FIGS. 11A, 11B, 11C, 11D, and 11E are perspective views showing the manner in which the female TPA device enters the female housing, wherein: FIG. 11A shows, in an exploded view, the female TPA device ready to be inserted into the female housing; FIG. 11B shows the female TPA device having entered the female housing; FIG. 11C shows the female TPA device being about half-way inserted into the female housing; FIG. 11D illustrates the female TPA device, in the pre-lock position, in the female housing; and FIG. 11E illustrates the female TPA device, in the full-lock position, in the female housing.

DETAILED DESCRIPTION OF THE PREFERRED EMBODIMENTS

Figure 1:
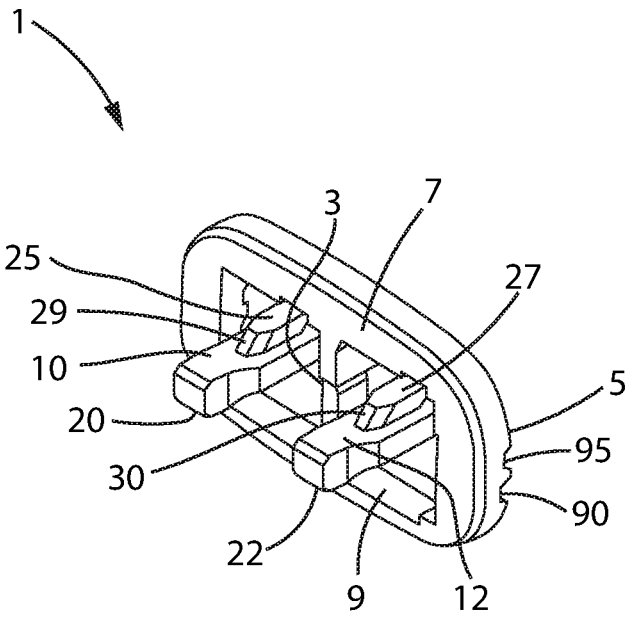
FIG. 1 is a front perspective view of a female terminal position assurance (TPA) device of this invention for use in a female connector assembly.

FIG. 1 illustrates a front perspective view of the female terminal position (TPA) device, generally referred to as reference numeral 1. The female TPA device 1 includes a middle member 3 and a rounded member 5. The middle member 3 extends from an upper portion 7 to a lower portion 9 of the rounded member 5. The rounded member 5 has, on opposite sides thereof, frontward extending members 10, 12 extending therefrom.

Figure 2:
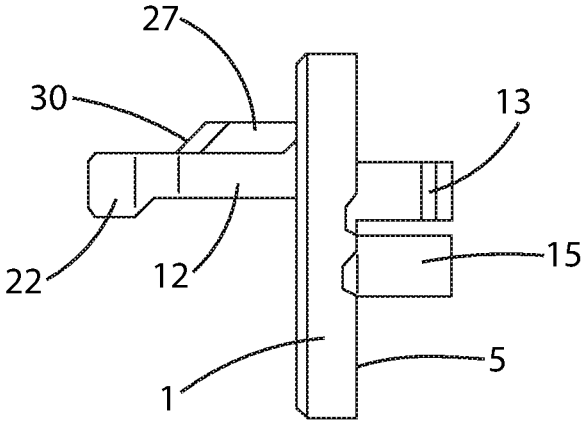
FIG. 2 is a side elevational view of the female TPA device of this invention.

Illustrated in FIG. 2 are an upper backward extending member 13 and a lower backward extending member 15. At a front end of each of the frontward extending members 10, 12 is a corresponding front downward extending member 20, 22. Also each of the frontward extending members 10, 12 has a corresponding upper member 25, 27; and each of the upper members 25, 27 has a corresponding ramp-like front end 29, 30.

Figure 3:
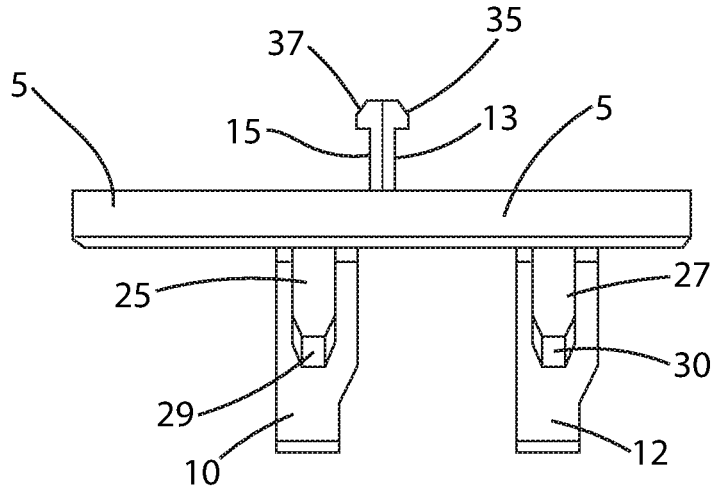
FIG. 3 is a top elevational view of the female TPA device of this invention.
Figure 4:
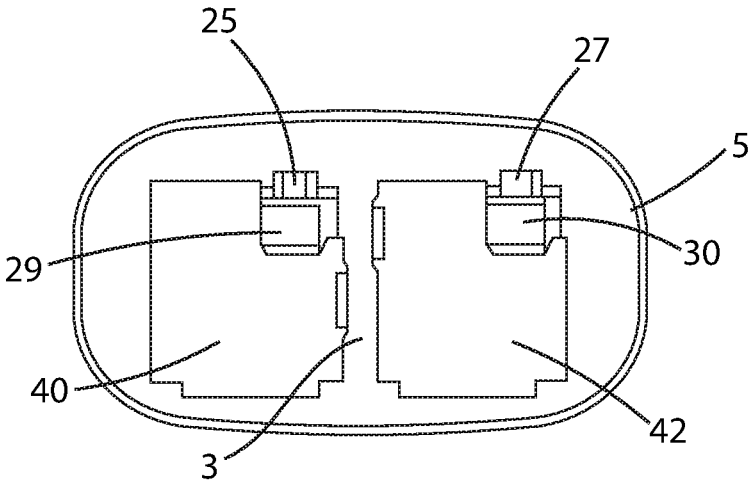
FIG. 4 is a front elevational view of the female TPA device of this invention.

Shown in FIG. 3 is a top elevational view of the female TPA device 1, which illustrates the frontward extending members 10, 12, the corresponding upper members 25, 27 respectively extending therefrom, and the ramp-like front ends 29, 30, respectively, thereof. Also shown are the upper backward extending member 13 and the lower backward extending member 15. The upper backward extending member 13 has an upper barb-like member 35 extending therefrom, while the lower backward extending member 15 has a lower barb-like member 37 extending therefrom. Passing through both sides of the female TPA device 1 are openings 40, 42 with the middle member 3 therebetween, as shown in FIG. 4.

Figure 5:
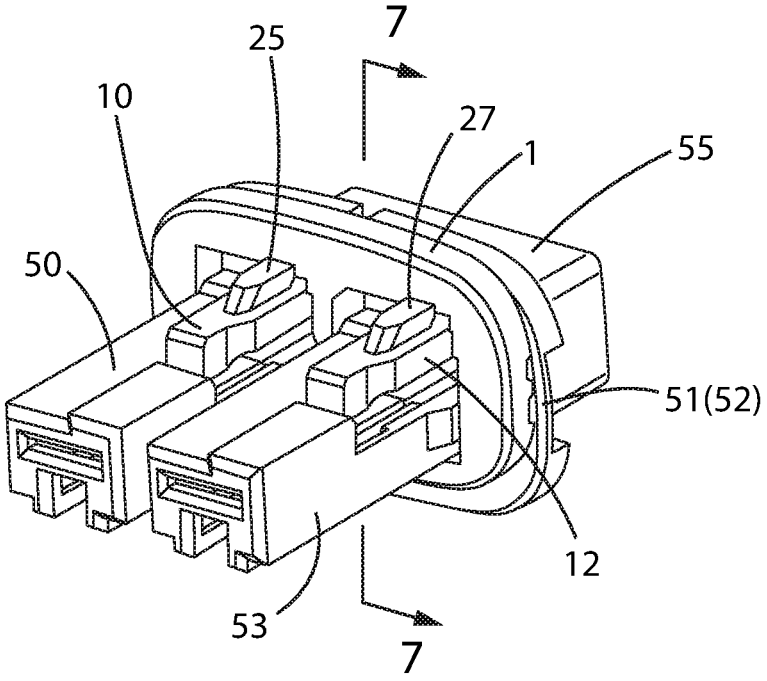
FIG. 5 is a perspective view of the female TPA device of this invention fitted or installed, in a female housing, at a pre-lock position.
Figure 6:
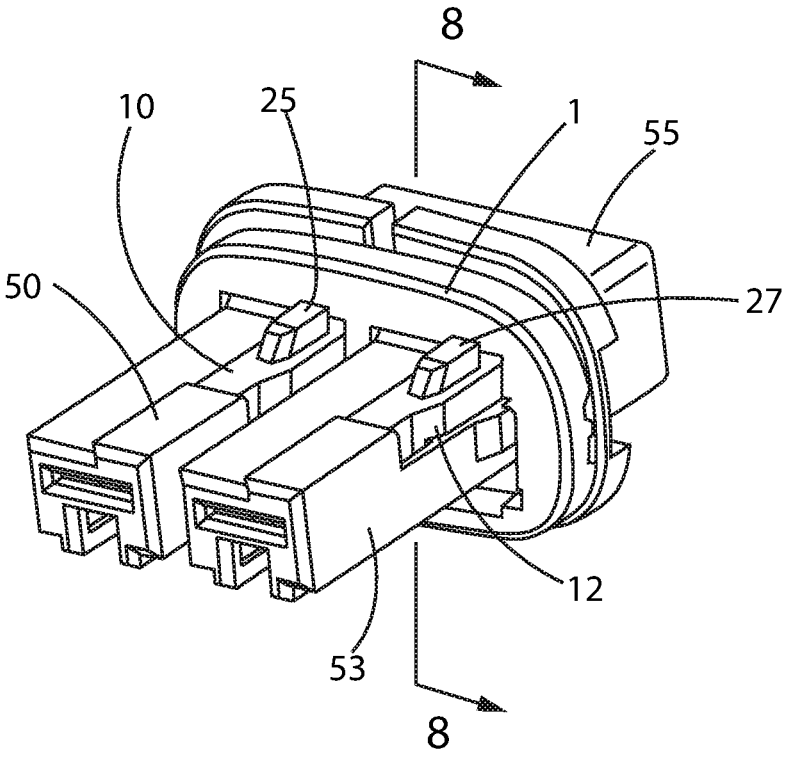
FIG. 6 is a perspective view of the female TPA device of this invention fitted or installed, in a female housing, at a full-lock position.

FIG. 5 illustrates the female TPA device in a pre-lock position while inserted into and mounted onto a female housing 50. The female housing 50 has a front portion 53 and a rear portion 55. FIG. 6 illustrates the female TPA device 1 in a full-lock position while inserted into and mounted onto the female housing 50.

Figure 7:
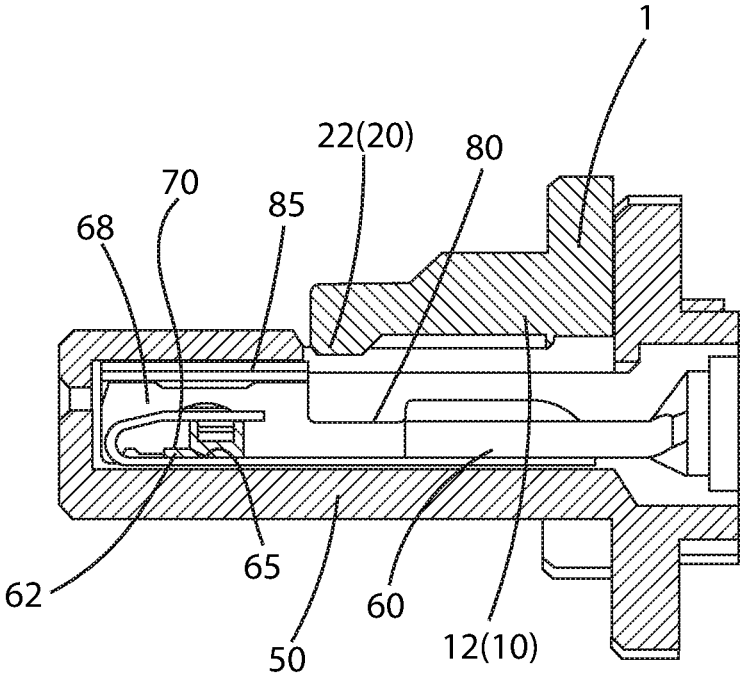
FIG. 7 is a cross-sectional view taken along cross-sectional line 7-7 in FIG. 5 showing a corresponding terminal with a corresponding front downward extending member of a corresponding frontward extending member of the female TPA device in a pre-lock position inside the female housing.

A primary lock for a terminal 60, inside the female housing 50, is hereafter described. As shown in FIG. 7, a protruding member 62 extends from a lower portion of the female housing 50. The protruding member 62 includes a ramp-like leading end 65. A leading portion 68 of the terminal 60, in turn, has a notch 70 such that when the terminal 60 is fully inserted into the female housing 50, the notch 70 readily passes over the ramp-like leading end 65 of the protruding member 62. Upon the terminal 60 being fully inserted into the female housing 50, the protruding member 62 of the female housing 50 snaps into the notch 70 of the leading end portion 68 of the terminal 60, thereby locking (primary lock) the terminal 60 inside the female housing 50.

FIG. 7 further shows a cross-sectional view taken along line 7-7 in FIG. 5, wherein the female TPA device 1 is at a pre-lock position. As discussed above, the terminal 60 is locked (primary lock) when the protruding member 62 inside the female housing 50 snaps into or enters the notch 70 of the leading end portion 68 of the terminal 60. Consequently, the terminal 60 cannot be pulled out from the female housing 50; and such time, an upper notch 80 of the terminal 60 becomes available for receiving or accommodating therein a corresponding one of the front downward extending members 20, 22. That is, unless the terminal 60 is in the primary lock inside the female housing 50 and the upper notch 80 of the terminal 60 is available to receive or accommodate therein a corresponding one of the front downward extending members 20, 22, the front downward extending members 20, 22 are unable to provide the necessary secondary lock to the terminal 60 inside the female housing 50. In other words, if the terminal 60 is not in the primary lock inside the female housing 50, the female TPA device 1 is prevented, by an upper portion 85 of the leading portion 68 of the terminal 60, from being further pushed downward. Consequently, if the upper portion 85 of the leading portion 68 of the terminal 60 blocks the female TPA device (more particularly, blocks the front downward extending members 20, 22 of the female TPA device 1), the female TPA device 1 is able to detect that it is unable to be further pushed downward, and therefore unable to provide the secondary lock for the terminal 60 inside the female housing 50 (i.e., the female TPA device 1 cannot be further pushed downward to the full-lock position).

Figure 8:
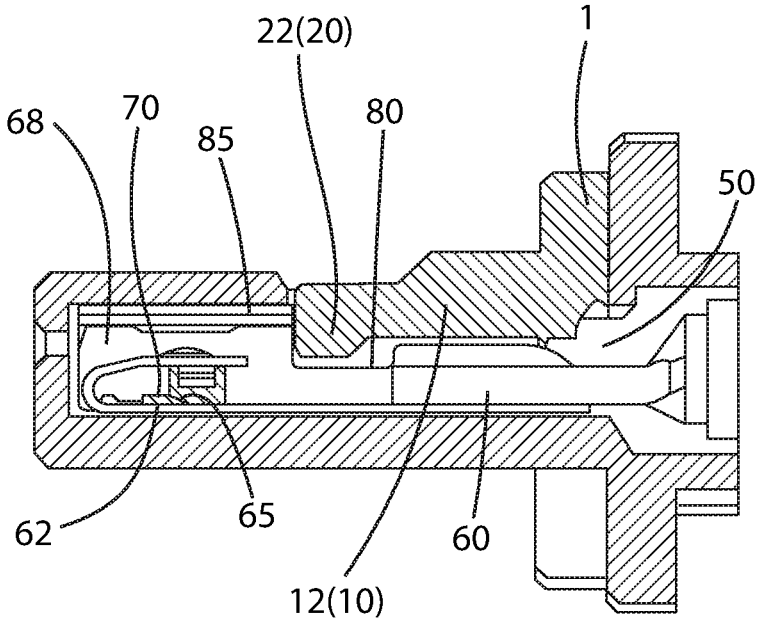
FIG. 8 is a cross-sectional view taken along cross-sectional line 8-8 in FIG. 6 showing the corresponding terminal with the corresponding front downward extending member of the corresponding frontward extending member of the female TPA device in a full-lock position inside the female housing.

FIG. 8 illustrates the female TPA device 1 being in the full-lock position inside the female housing 50. Here, the upper notch 80 of the terminal 60 becomes available for accommodating therein the corresponding one of the front downward extending members 20, 22 of the female TPA device 1; and therefore, when inserted inside a respective one of the upper notches 80 of the terminals 60, the front downward extending members 20, 22 of the female TPA device 1 respectively block the terminals 60 from being pulled out from the inner housing 50, and thus able to provide the secondary lock for the terminals 60 inside the female housing 50.

Figure 9:
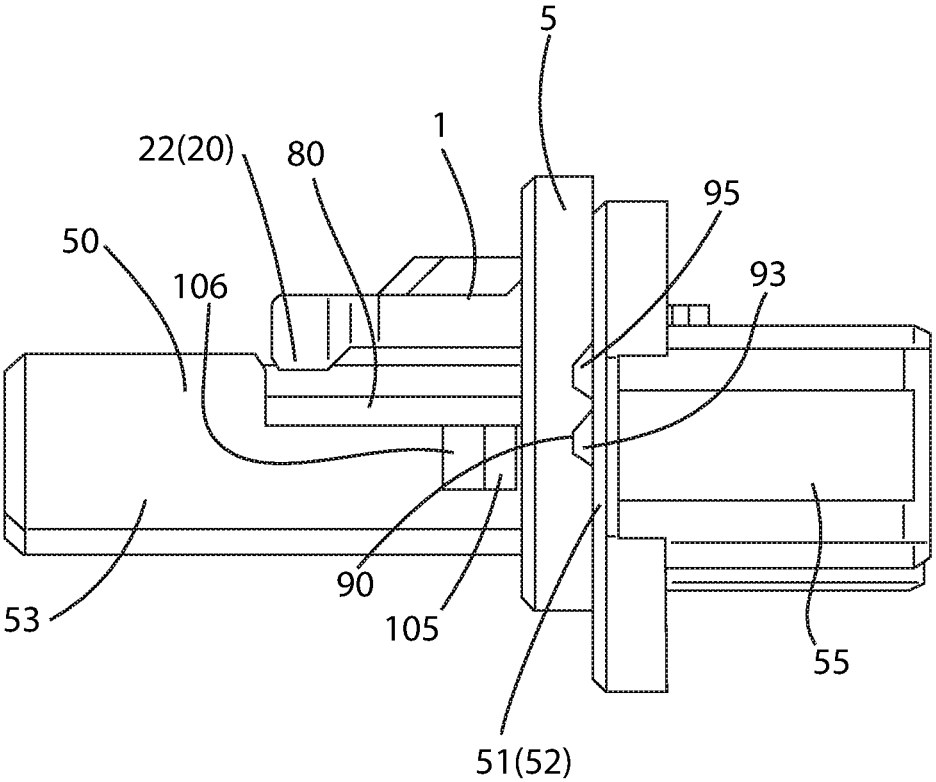
FIG. 9 is a side elevational view of the female TPA device, in the pre-lock position, in the female housing.

In addition to what are shown in FIGS. 5 and 7 with respect to the pre-lock position of the female TPA device 1, FIG. 9 further illustrates yet another feature or structural arrangement of the female TPA device 1, when in the pre-lock position.

In FIG. 9, when the female TPA device 1 is pushed downward into the female housing 50, a corresponding one of lower notches 90 on the rounded member 5 of the female TPA device 1 accommodates therein a locking nub member 93 extending from a corresponding flexible locking arm 51 of the female housing 50 such that the locking nub member 93 enters into the corresponding one of the lower notches 90. A similar feature or structural arrangement occurs in the opposite side of the rounded member 5. That is, in the opposite side of the rounded member 5, a corresponding lower notch 90 is located thereon such that when the female TPA device 1 is pushed in the pre-lock position, the corresponding locking nub member 93 similarly enters into the corresponding lower notch 90 of the corresponding opposite side of the female TPA device 1.

Figure 10:
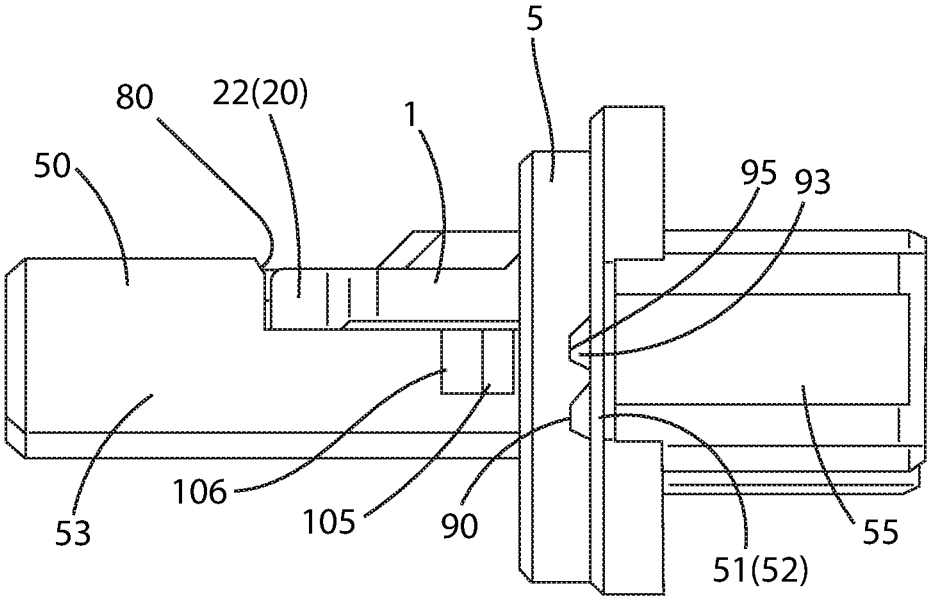
FIG. 10 is a side elevational view of the female TPA device, in the full-lock position, in the female housing.

In addition to what are shown in FIGS. 6 and 8 with respect to the full-lock position of the female TPA device 1, FIG. 10 further illustrates yet another feature or structural arrangement of the female TPA device 1, when in the full-lock position.

In FIG. 10, when the female TPA device 1 is further pushed downward into the female housing 50, an upper notch 95 on the side of the rounded member 5 of the female TPA device 1 accommodates therein the locking nub member 93 extending from the corresponding flexible locking arm 51 of the female housing 50. A similar structural arrangement is in the opposite side of the rounded member 5. That is, in the opposite side of the rounded member 5, when the female TPA device 1 is pushed further downward in the full-lock position, the corresponding upper notch 95 similarly accommodates therein the locking nub member 93 extending from the corresponding flexible locking arm 52 at the opposite side of the female housing 50.

Also shown in FIGS. 9 and 10 are locking members 105 extending from opposite sides of the female housing 50, each of the locking members 105 having a ramp-like leading end 106 for permitting the rounded member 5 of the female TPA device 1 to traverse or travel along the front portion 53 of the female housing 50 towards the flexible locking arms 51, 52 thereof. Consequently, once the round member 5 of the female TPA device 1 has passed the locking members 105 of the female housing 50, it becomes difficult to retract the female TPA device 1 along the front portion 53 of the female housing 50.

The method for assembling or operating the female TPA device 1 in the female housing 50 for providing the secondary locks for the terminals 60 therein is hereinafter described. Explained hereinafter are the method steps for assembling or operating the female TPA device 1 with the female housing 50 in relation to FIGS. 11A, 11B, 11C, 11D, and 11E. It is noted that the pre-lock and the full-lock positions of the female TPA device 1 for locking the terminals 60 inside the female housing 50 hereinafter described in FIGS. 11A, 11B, 11C, 11D, and 11E include each of the terminals 60 (although not shown in FIGS. 11A, 11B, 11C, 11D, and 11E) inside the female housing 50 being in the primary lock, similar to as illustrated and described above with respect to FIGS. 5 and 7 (the female TPA device 1 in the pre-lock position) and with respect to FIGS. 6 and 8 (the female TPA device 1 in the full-lock position).

Figure 11A:
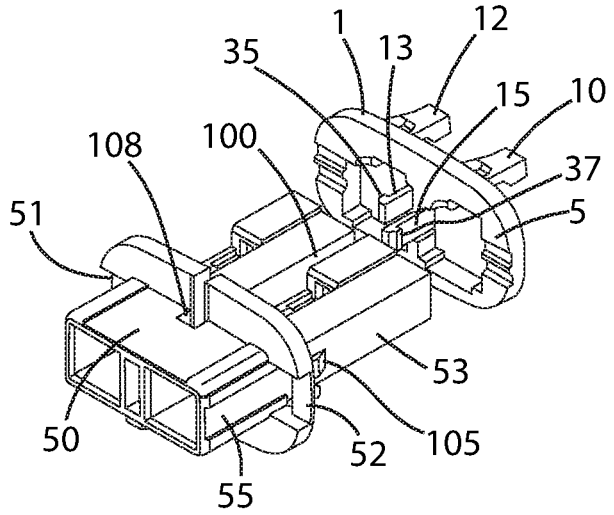

FIG. 11A is an exploded view of the female TPA device 1 and the female housing 50. Here, the upper backward extending member 13 and the lower backward extending member 15 face the front portion 53 of the female housing 50 ready to be inserted into or mounted onto the female housing 50. More particularly, the upper backward extending member 13 and the lower backward extending member 15 are ready to be inserted into a slit 100 partially extending substantially along the length of the female housing 50.

Figure 11B:
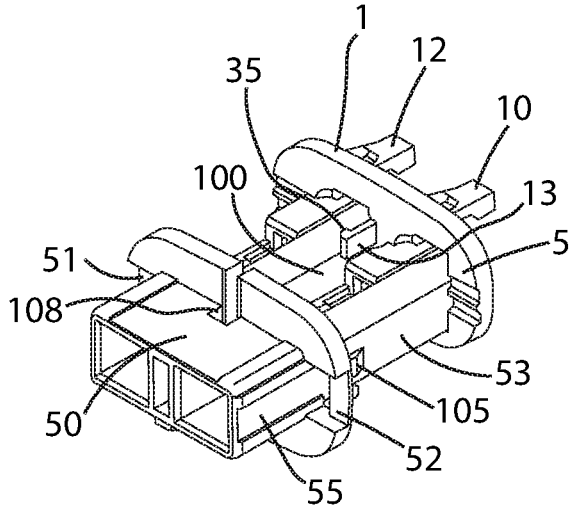
Figure 11C:
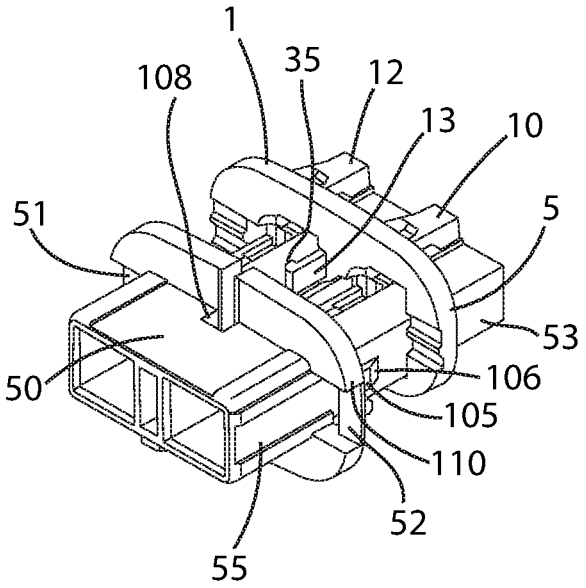

In FIG. 11B, the female housing 50 has entered the openings 40, 42 of the female TPA device 1, while the upper backward extending member 13 and the lower backward extending member 15 have both entered the slit 100 of the female housing 50. In FIG. 11C, the female TPA device 1 has further been pushed along the front portion 53 and towards an intermediate member 110 of the female housing 50, the rounded member 5 of the female TPA device 1 now being at approximately midway the front portion 53 of the female housing 50. Hereinafter, the female TPA device 1 is further pushed along the front portion 53 and towards the intermediate member 110 of the female housing 50, as shown in FIG. 11D.

Figure 11D:
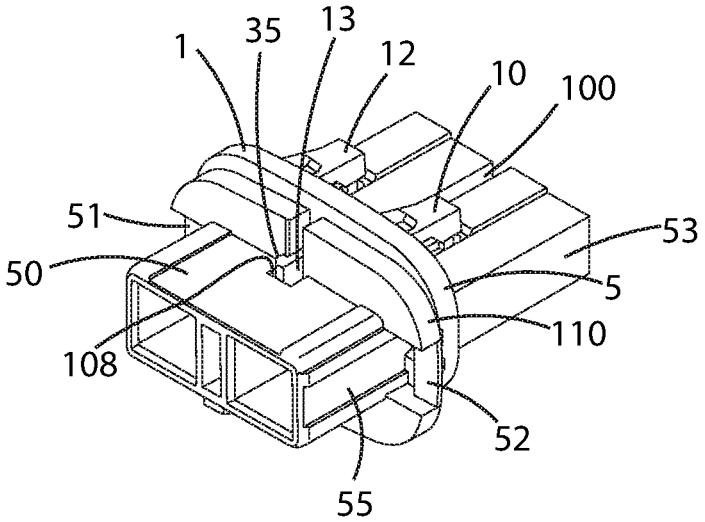

FIG. 11D illustrates the female TPA device 1, in the pre-lock position, in the female housing 50. At this pre-lock position of the female TPA device, the descriptions in the manner in which the terminals 60 are disposed in relation to the female TPA device 1 and the female housing 50, as described with respect to and as illustrated in FIGS. 5 and 7, are similarly applicable in the structural arrangement shown in FIG. 11D. In other words, it is presumed in FIG. 1D that the terminals 60 are in primary locks inside the female housing 50, in a similar manner as descried earlier with respect to and illustrated in FIGS. 5 and 7, In FIG. 11D, both the upper barb-like member 35 of the upper backward extending member 13 and the lower barb-like member 37 (see FIG. 11A) of the lower backward extending member 15 have entered a space 108 behind the intermediate member 110 of the female housing 50, the space 108 being located in the rear portion 55 of the female housing 50. The upper barb-like member 35 and the lower barb-like member 37 have thus become engaged with the intermediate member 110 of the female housing 50. Consequently, it becomes difficult to retract the female TPA device 1, along the front portion 53 of the female housing 50, away from the intermediate member 110 of the female housing 50. Similarly, in FIG. 11D, as discussed above with respect to FIGS. 9 and 10, the locking members 105 (see, for example, FIG. 11C) extending from opposite sides of the female housing 50 (each of the locking members 105 having a ramp-like leading end 106 (see, for example, FIGS. 9 and 11C) for permitting the rounded member 5 of the female TPA device 1 to traverse or travel along the front portion 53 of the female housing 50 towards the flexible locking arms 51, 52 thereof) respectively locking the rounded member 5 of the female TPA device 1 to the intermediate member 110 or more particularly, to the flexible locking arms 51, 52 of the inner housing 50. Consequently, once the rounded member 5 of the female TPA device 1 has passed the locking members 105 of the female housing 50, it further becomes difficult to retract the female TPA device 1, along the front portion 53 of the female housing 50, away from the intermediate member 110 of the female housing 50.

Figure 11E:
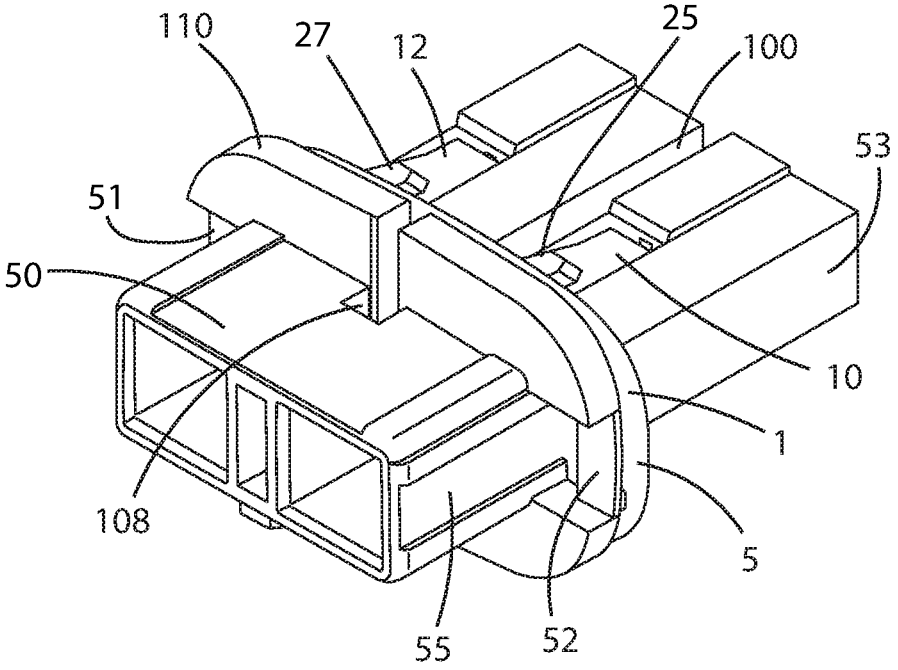

FIG. 11E illustrates the female TPA device 1, in the full-lock position, in the female housing 50. At this full-lock position of the female TPA device 1, the descriptions in the manner in which the terminals 60 are disposed in relation to the TPA device 1 and the female housing 50, as described with respect to and illustrated in FIGS. 6 and 8, are similarly applicable in the structural arrangement shown in FIG. 11E. In other words, it is presumed in FIG. 11E that the terminals 60 are in the primary locks inside the female housing 50, in a similar manner, as described with respect to and illustrated in FIGS. 6 and 8.

Similar to as described above in the pre-lock position in FIG. 11D, in the structural arrangement shown in FIG. 11E, the upper barb-like member 35 and the lower barb-like member 37 of the female TPA device 1 have entered the space 108 of the female housing 50; and thus, the upper barb-like member 35 and the lower barb-like member 37 have become engaged with the intermediate member 110 of the female housing 50. Also, the locking members 105 of the female housing 50 have respectively locked the rounded member 5 of the female TPA device 1 to the flexible locking arms 51, 52 of the female housing 50. Relative to FIG. 11D, the female TPA device 1 is further pushed downward (as described earlier with respect to and as illustrated in FIGS. 6 and 8). Consequently, the female TPA device 1, as shown in FIG. 11E, is in full-lock position, provides the secondary locks for the terminals 60, is engaged with the flexible locking arms 51, 52 of the female housing 50, and the backward extending members 13, 15 thereof are locked inside the rear portion 55 of the female housing 50.

The female TPA device 1 of this invention provides the pre-lock and full-lock positions outside of the body of the female housing 50, unlike a typical ISL TPA device. This invention is also highly suitable for high voltage terminals, which are larger terminals, and provides for long frontward extending members 10, 12. This structural arrangement aids in "finger proofing" by the use of large terminals. For small terminals, the opening needed is by nature small so that very small digits would not be able to be inserted into the opening, and as such, would not be able to contact the terminal. However, in this invention, its use for large high voltage terminals allows for the opening to also be large and allows for small fingers to be inserted for making contact with the terminals. With the above-described characteristics of this invention, "creepage" (a measurement of the shortest path along the surface from any given circuit in a connector to any (usually adjacent) other circuit), and "clearance" (defined as, e.g., a measurement of the shortest electrical path from any exposed electrically conducting element in a given circuit of a connector to any other electrically conducting element in a different circuit in the same connector) are advantageously increased.

The present invention is not limited to the above-described embodiments; and various modifications in design, structural arrangement or the like may be used without departing from the scope or equivalents of the present invention.

I claim:

1. A female terminal position assurance (TPA) device for a female connector assembly having a female housing, comprising:

a rounded member that substantially extends along an entire periphery of said TPA device, said rounded member having a set of notches that alternatively lock with said female connector assembly;

a middle member extending from an upper portion o a lower portion of said rounded member;

frontward extending members respectively extending from opposite sides of said rounded member, wherein at a front end of each of said frontward extending members is a corresponding front downward extending member, said frontward extending members extending substantially perpendicularly from said rounded member; and an upper backward extending member and a lower backward extending member, said upper and lower backward extending members extending substantially perpendicularly from said rounded member, wherein said rounded member surrounds said frontward extending members, and further surrounds said upper and lower backward extending members, wherein said upper and lower backward extending members extend from said middle member, wherein said upper backward extending member extends from an upper portion of said middle member and said lower backward extending member extends from a lower portion of said middle member, and wherein said frontward extending members extend from an upper portion of said rounded member.

2. The female TPA device according to claim 1, wherein said rounded member includes a set of a lower notch and an upper notch on opposite sides thereof.

3. The female TPA device according to claim 1, wherein said corresponding front downward extending member of each of said frontward extending members blocks a corresponding one of terminals inserted inside said female housing when said female TPA device is at a full-lock position.

4. The female TPA device according to claim 2, wherein said lower notch on a corresponding side of said rounded member engages with or locks a locking nub on said corresponding flexible locking arm of said female housing when said female TPA device is at a pre-lock position inside said female housing.

5. The female TPA device according to claim 4, wherein said upper notch on a corresponding side of said rounded member engages with or locks a locking nub on said corresponding flexible locking arm of said female housing when said female TPA device is at a full-lock position inside said female housing.

6. The female TPA device according to claim 4, wherein said upper and lower backward extending members are locked inside said female housing.

7. The female TPA device according to claim 5, wherein said upper and lower backward extending members are locked inside said female housing.

8. The female TPA device according to claim 6, wherein said rounded member is locked by locking members respectively extending from said flexible locking arms of said female housing.

9. The female TPA device according to claim 7, wherein said rounded member is locked by locking members respectively extending from said flexible locking arms of said female housing.

10. A method for assembling a female terminal position assurance (TPA) device in a female connector assembly having a female housing, comprising the steps of:

inserting, in a first direction, at least a terminal into said female housing;

sliding a rounded member of said female TPA device towards flexible locking arms of said female housing;

detecting if said terminal is in a primary lock position inside said female housing; and if said terminal is in said primary lock inside said female housing, then pushing said female TPA device in a second direction inside said female housing and providing a secondary lock position for said terminal inside said female housing, wherein said first direction and said second direction are substantially dissimilar, and wherein said step of detecting if said terminal is in said primary lock inside said female housing includes a step of allowing a front downward extending member of a corresponding frontward extending member of said female TPA device to become accommodated inside a notch of said terminal to thereby block said terminal from being pulled out from said female housing and provide said secondary lock for said terminal inside said female housing.

11. The method for assembling said female TPA device in said female connector assembly according to claim 10, wherein said step of inserting said terminal inside said female housing includes a step of having a protruding member inside said female housing accommodated inside a notch of said terminal; and thereafter, providing said primary lock for said terminal inside said female housing.

12. The method for assembling said female TPA device in said female connector assembly according to claim 10, wherein said step of sliding said rounded member towards said flexible locking arms of said female housing includes a step of locking at least a backward extending member of said female TPA device inside said female housing.

13. The method for assembling said female TPA device in said female connector assembly according to claim 10, wherein said step of pushing said female TPA device downwards includes a step of pushing said female TPA device to a pre-lock position, and subsequently to a full-lock position, inside said female housing.

14. The method for assembling the female TPA device in said female connector assembly according to claim 10, wherein said step of pushing said female TPA device downwards includes a step of further pushing said female TPA device to a full-lock position.

15. The method for assembling said female TPA device in said female connector assembly according to claim 13, wherein said step of pushing said female TPA device to said pre-lock position, and subsequently to said full-lock position, includes a step of locking a locking nub extending from a corresponding one of said flexible locking arms of said female housing inside a lower notch, and subsequently inside an upper notch, in a corresponding side of said female TPA device.

16. The method for assembling said female TPA device in said female connector assembly according to claim 14, wherein said step of pushing said female TPA device to said full-lock position includes a step of locking a locking nub extending from a corresponding one of said flexible locking arms of said female housing inside an upper notch in a corresponding side of said female TPA device.

17. The method for assembling said female TPA device in said female connector assembly according to claim 15, wherein locking members respectively extending from opposing sides of said female housing respectively lock opposing sides of said rounded member of said female TPA device when said female TPA device is at said pre-lock position, and subsequently at said full-lock position inside said female housing.

18. The method for assembling said female TPA device in said female connector assembly according to claim 16, wherein locking members respectively extending from opposing sides of said female housing respectively lock opposing sides of said rounded member of said female TPA device when said female TPA device is at said full-lock position inside said female housing.

19. The female TPA device according to claim 1, wherein said rounded member includes apertures passing therethrough, said middle member being between said apertures.

20. The female TPA device according to claim 19, wherein said apertures passing through said rounded member accommodates therein said female housing.

* * * * *